US011230746B2

(12) United States Patent
Wilden et al.

(10) Patent No.: US 11,230,746 B2
(45) Date of Patent: Jan. 25, 2022

(54) HEAT TREATMENT METHOD AND HEAT TREATMENT APPARATUS

(71) Applicant: SCHWARTZ GMBH, Simmerath (DE)

(72) Inventors: Frank Wilden, Simmerath (DE); Jörg Winkel, Nideqqen-Schmidt (DE); Andreas Reinartz, Monschau (DE)

(73) Assignee: Schwartz GmbH, Simmerath (DE)

( * ) Notice: Subject to any disclaimer, the term of this patent is extended or adjusted under 35 U.S.C. 154(b) by 28 days.

(21) Appl. No.: 16/076,135

(22) PCT Filed: Jan. 25, 2017

(86) PCT No.: PCT/EP2017/051568
§ 371 (c)(1),
(2) Date: Aug. 7, 2018

(87) PCT Pub. No.: WO2017/137259
PCT Pub. Date: Aug. 17, 2017

(65) Prior Publication Data

US 2021/0230711 A1 Jul. 29, 2021

(30) Foreign Application Priority Data

Feb. 9, 2016 (DE) ..... 10 2016 201 936.8

(51) Int. Cl.
*C21D 9/00* (2006.01)
*C21D 1/22* (2006.01)
*C21D 1/673* (2006.01)

(52) U.S. Cl.
CPC ..... *C21D 9/0062* (2013.01); *C21D 1/22* (2013.01); *C21D 1/673* (2013.01); *C21D 2211/001* (2013.01); *C21D 2211/008* (2013.01)

(58) Field of Classification Search
CPC ..... C21D 9/0062; C21D 1/22; C21D 1/673; C21D 2211/008; C21D 2211/001
See application file for complete search history.

(56) References Cited

U.S. PATENT DOCUMENTS 6,228,188 B1 * 5/2001 Meersschaut ..... C21D 9/525 148/595
2004/0060623 A1 * 4/2004 Boke ..... C21D 9/46 148/641
2011/0139320 A1 * 6/2011 Bramfitt ..... C22C 38/001 148/581
2012/0090741 A1 4/2012 Pellmann et al.
2016/0010171 A1 1/2016 Naitou et al.

FOREIGN PATENT DOCUMENTS

| | | | |
|---|---|---|---|
| DE | 10208216 | | 3/2003 |
| DE | 102010048209 | | 1/2012 |
| DE | 102010049205 | A1 | 4/2012 |
| DE | 102014201259 | A1 | 7/2015 |
| EP | 2548975 | | 1/2013 |
| EP | 2679692 | | 1/2014 |
| KR | 10-2012-0110961 | A | 10/2012 |
| KR | 101277864 | B1 * | 6/2013 |

OTHER PUBLICATIONS

KR-101277864-B1, Cho Han Gu; Cho Yeol Rae; Kim Dong Jin; Kim Tai Ho, English Translation provided from EPO, 2013 (Year: 2013).*
KR-101277864-B1, Cho Han Gu; Cho Yeol Rae; Kim Dong Jin; Kim Tai Ho, English Translation obtained from EPO, 2013 (Year: 2013).*
Japanese Office Action dated Nov. 24, 2020 in JP Application No. 2018-560720.

* cited by examiner

*Primary Examiner* — Anthony J Zimmer
*Assistant Examiner* — Jacob J Gusewelle
(74) *Attorney, Agent, or Firm* — Occhiuti & Rohlicek LLP

(57) ABSTRACT

The invention relates to a method and an apparatus for the targeted heat treatment of specific component zones of a steel component. A predominantly austenitic structure can be created in the steel component in one or more first regions, from which, by quenching, a majority martensitic microstructure can be created; and in one or more second regions, a majority bainitic microstructure can be created, wherein the steel component is initially heated in a furnace to a temperature above the AC3 temperature, the steel component is subsequently transferred into a treatment station, and can cool down during the transfer, and in the treatment station, the one or more second regions of the steel component are cooled down to a cooling finish temperature $\vartheta_2$ during a treatment time.

5 Claims, 4 Drawing Sheets

HEAT TREATMENT METHOD AND HEAT TREATMENT APPARATUS

CROSS REFERENCE TO RELATED APPLICATIONS

Figure 1:
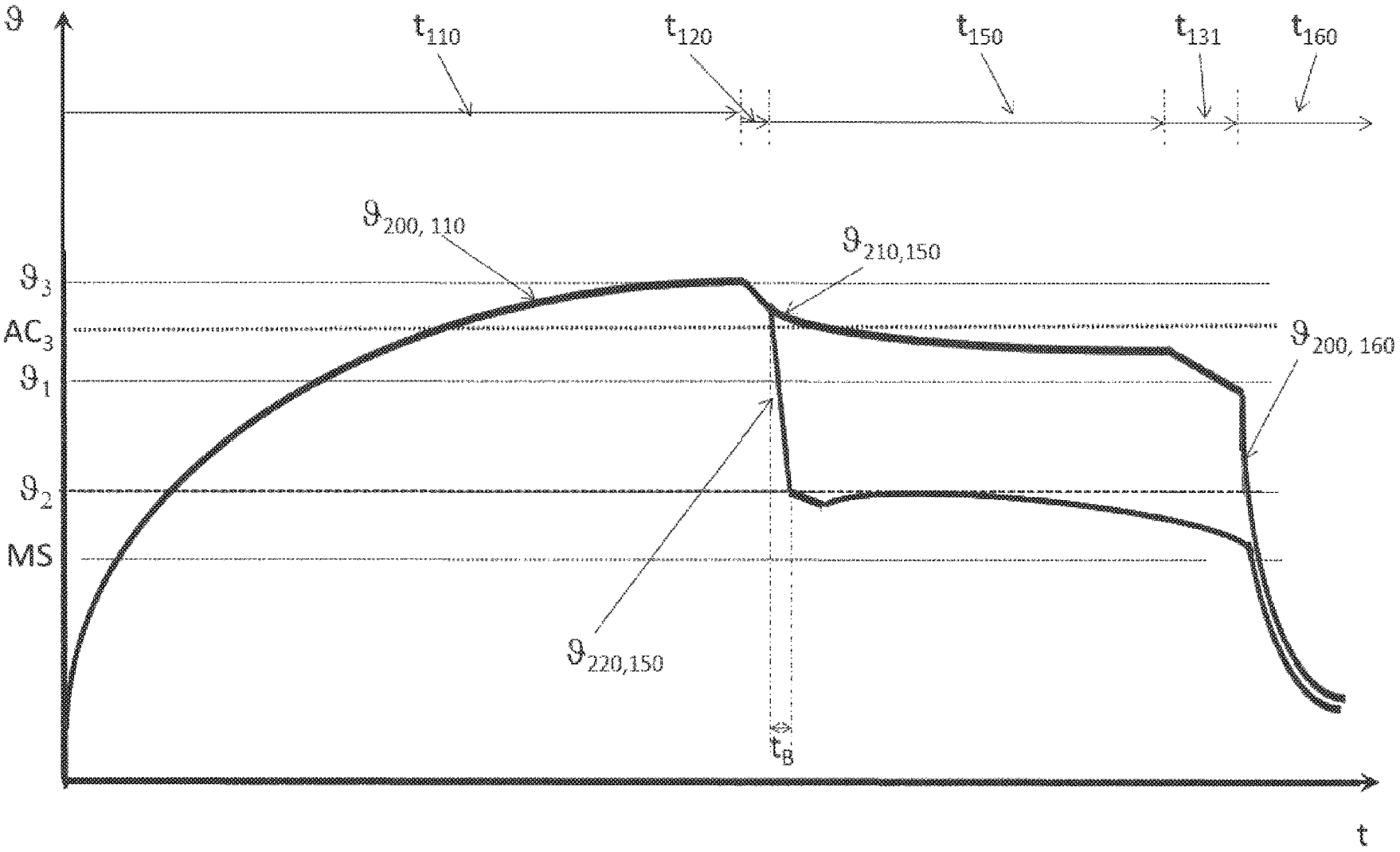

This application is a National Phase under 35 U.S.C. 371 of International Application No. PCT/EP2017/051568 filed on Jan. 25, 2017, which claims priority to German Application No. 10 2016 201 936.8 filed Feb. 9, 2016, the contents of which are hereby incorporated by reference in their entirety.

DESCRIPTION

The invention relates to a method and an apparatus for the targeted heat treatment of specific component zones of a steel component.

In many applications in technical industries, a desire exists for high-strength sheet metal parts with low part weight. For example, the automotive industry is endeavoring to reduce fuel consumption of motor vehicles, and reduce $CO_2$ emissions, while at the same time increasing passenger safety. As a result, the demand for body components with a favorable ratio of strength to weight is rapidly increasing. These components include, in particular, A and B pillars, side impact protection beams in doors, sills frame parts, bumpers, cross-members for floor and roof, and front and rear chassis beams. In modern motor vehicles, the bodyshell, with a safety cage, usually consists of a hardened steel sheet with a strength of about 1500 MPa. Al/Si-coated steel sheets are commonly used. The process of press-hardening was developed for the production of a component from hardened steel sheet. In this process, steel sheets are first heated to the austenitizing temperature, then placed in a press tool, quickly formed, and rapidly quenched by the water-cooled tool to below martensite start temperature. This creates a hard, strong, martensitic structure with a strength of approx. 1500 MPa. However, such a hardened steel sheet has a low elongation at break. For this reason, the kinetic energy of an impact cannot be sufficiently converted into deformation heat.

For the automotive industry, it is therefore desirable to be able to produce body components that have several different expansion and strength zones in the component, such that comparatively strong regions (hereinafter called first regions), on the one hand, and more extensible regions (hereinafter called second regions), on the other hand, are present in a component. On the one hand, components with high strength are generally desirable in order for the components to have high mechanical strength with low weight. On the other hand, high-strength components should be able to have partially soft regions. This achieves the desired, partially-elevated deformability in the event of a crash. This is the only way to reduce the kinetic energy of an impact, thus minimizing the acceleration forces on the passengers and the rest of the vehicle. In addition, modern joining methods require softened points, which enable the joining of identical or different materials. Often, for example, fold-, crimp-, or rivet connections must be used, and these require deformable regions in the component.

In addition, the general requirements of a production plant should also be taken into account: There should be no cycle time loss at the press hardening station, the plant overall should be used without any general restrictions, and the plant should be able to undergo product-specific conversion quickly. The process should be robust and economical, and the production plant should need only the minimum of space. The shape and edge accuracy of the component should be high.

In all known methods, the targeted heat treatment of the component takes place in a time-intensive treatment step, which has a significant influence on the cycle time of the entire production line.

The object of the invention is therefore to provide a method and an apparatus for the targeted heat treatment of specific component zones of a steel component, wherein regions of different hardness and ductility can be achieved, and wherein the influence thereof on the cycle time of the overall heat treatment apparatus is minimized.

According to the invention, this object is achieved by a method having the features of independent claim 1. Advantageous developments of the method will become apparent from dependent claims 2 to 6. The object is further achieved by an apparatus according to claim 8. Advantageous embodiments of the apparatus will become apparent from dependent claims 9 to 16.

The steel component is first heated to above the austenitizing temperature AC3 so that the structure can completely convert to austenite. In a subsequent hardening process—for example, the press-hardening process the component is quenched quickly enough that a martensitic microstructure primarily forms, and strengths of about 1500 MPa are achieved. The quenching takes place advantageously from the fully austenitized structure. To this end, cooling must begin, with at least the lower, critical cooling rate, at the latest once the temperature drops below the microstructure transformation start temperature $\vartheta_1$, at which microstructural transformations can begin. For example, in the case of 22MnB5 which is typically used for press hardening, 660° C. should be taken as the approximate boundary $\vartheta_1$. An at least-partially martensitic microstructure can still arise if the quenching starts at a lower temperature; however, reduced strength of the component in this region will then be expected.

This temperature profile is typical for a press-hardening process for fully-hardened components in particular.

A second region or a plurality of second regions are likewise first heated to above the austenitizing temperature AC3, such that the microstructure can completely transform into austenite. Next, the component is cooled as quickly as possible within a treatment time $t_B$, down to a cooldown finish temperature $\vartheta_2$. By way of example, for the material 22MnB5, this should be below 650° C. For example, the martensite start temperature for 22 MnB5 is around 410° C. A slight oscillation into temperature ranges below the martensite start temperature is also possible. The rapid cooling is subsequently not continued, such that a bainitic microstructure predominantly forms. This microstructure transformation requires a treatment time, rather than happening abruptly. The conversion is exothermic. In an advantageous embodiment, there is no active heating of the second region(s) in the treatment station during the treatment time $t_B$. If a potential increase in temperature of the second region(s) occurs during this time it is the result of recalescence. By adjusting the cooling rate and/or the target cooling temperature, as well as the dwell time before the component is pressed out, the desired strength and elongation values can be adjusted in general. These lie between the maximum achievable strength of the microstructure in the first region and the values of the untreated component. Investigations have shown that suppressing the temperature rise due to recalescence, using a further, forced cooling, is rather disadvantageous for the achievable elongation values. Accordingly, an isothermal hold at the cooling temperature does not seem to be advantageous.

In one embodiment, the second region or the second regions are additionally actively heated in this phase. This can be done, for example, using heat radiation.

In one embodiment, the cooling finish temperature $\vartheta_2$ is selected to be higher than the martensite start temperature $M_S$.

In an alternative embodiment, the cooling finish temperature $\vartheta_2$ is selected to be below the martensite start temperature $M_S$.

The heat treatment of the first and second regions is generally different. The treatment of the second region or the second regions proceeds primarily is accordance with the duration of treatment. According to the invention, second regions are partially cooled to the cooling stop temperature $\vartheta_2$, within a treatment time $t_B$ of a few seconds, in a downstream treatment station in a furnace, so as to reach the austenitizing temperature. In this treatment station, it is ensured during the treatment period—if necessary, by supplying heat—that the first region or the first regions do not drop below a temperature below which sufficient martensite formation would not be expected during the subsequent press hardening. Depending on the duration of treatment, it is sufficient to minimize the radiation losses of the first region or the first regions—for example, using thermal insulation or reflectors for thermal radiation.

Optionally, the treatment station may be at least partially heated for this purpose. For this purpose, heat can be applied via convection or heat radiation, by way of example. Additionally or exclusively in this case, in an advantageous embodiment a heating via laser radiation can be implemented.

According to the invention, the components remain for a short time—for example, a few seconds—in the treatment station, to allow the structural transformation of the second regions to occur.

If the dwell time for sufficient structural transformation in the treatment station is so great that the required cycle time is no longer achieved, it is advisable to provide two or more identical treatment stations which are fed sequentially. In an advantageous execution, the chambers are arranged one above the other. It is irrelevant in this case whether the treatment stations are moved vertically to overcome the height offset or the feed system performs the necessary vertical movement.

By way of example, a continuous furnace or a batch furnace, such as a chamber furnace, for example, can be used as a furnace. Continuous furnaces usually have a high capacity and are particularly well-suited for mass production since they can be fed and operated without much effort.

In an advantageous embodiment, the component is blown from only one side. This achieves a clear separation of the conveyor technology—for example, below the component—and the cooling device—for example, above the component—which greatly simplifies the structural design of the treatment station or the treatment stations.

According to the invention, the treatment station has a device for rapidly cooling one or more second regions of the steel component. In a preferred embodiment, the device has a nozzle for blowing the second region or regions of the steel component with a gaseous fluid—such as air, or an inert gas such as nitrogen.

In a further advantageous embodiment of the method, the blowing of the second region or regions is carried out by blowing with a gaseous fluid, wherein water—for example, in nebulized form is added to the gaseous fluid. For this purpose, in an advantageous embodiment, the apparatus has one or more nebulizing nozzles. The blowing with the gaseous fluid mixed with water increases the heat removal from the second region(s). The evaporation of the water on the steel component achieves elevated heat dissipation and energy transport.

In a further embodiment, the second region or regions are cooled via heat conduction—for example by bringing them into contact with a punch or a plurality of punches, which has or have a significantly lower temperature than the steel component. For this purpose, the punch can be made of a material with good heat-conducting properties, and/or can be cooled directly or indirectly. A combination of the types of cooling can also be contemplated.

With the method according to the invention and the heat treatment apparatus according to the invention, steel components having one or multiple first and/or second regions, which can also be complex in shape, can be economically subjected to a corresponding temperature profile, since the different regions can be very quickly brought, with sharp boundaries, to the necessary process temperatures. Clearly contoured boundaries of the individual regions can be achieved between the two regions. Small spreads in the temperature level of the component have an advantageous effect for further processing in the press.

According to the invention, it is possible with the method shown and with the heat treatment apparatus according to the invention to create almost any number of second regions, which can also have different strength and elongation values from each other within the same steel component. Also, the selected geometry of the sub-regions is freely selectable. Point or line-shaped regions, as well as large-area regions, for example, can be created. The position of the regions is also of no significance. The second regions may be completely enclosed by first regions, or located at the edge of the steel component. Even a full-surface treatment can be contemplated. A limitation of the number of simultaneously-treated steel components is only produced by the press hardening tool or the conveying technology of the overall heat treatment apparatus. The method can also be applied to preformed steel components. The only result is greater constructive complexity to create the mating surfaces—due to the three-dimensionally shaped surfaces of preformed steel components.

Furthermore, it is advantageous that existing heat treatment systems can also be adapted to the method according to the invention. For this purpose, in a conventional heat treatment apparatus with only one furnace, it is only necessary to include the treatment station behind the same, and to adapt the feed devices.

Further advantages, features and advantageous developments of the invention will become apparent from the dependent claims and the following description of preferred embodiments with reference to the drawings.

Figure 2:
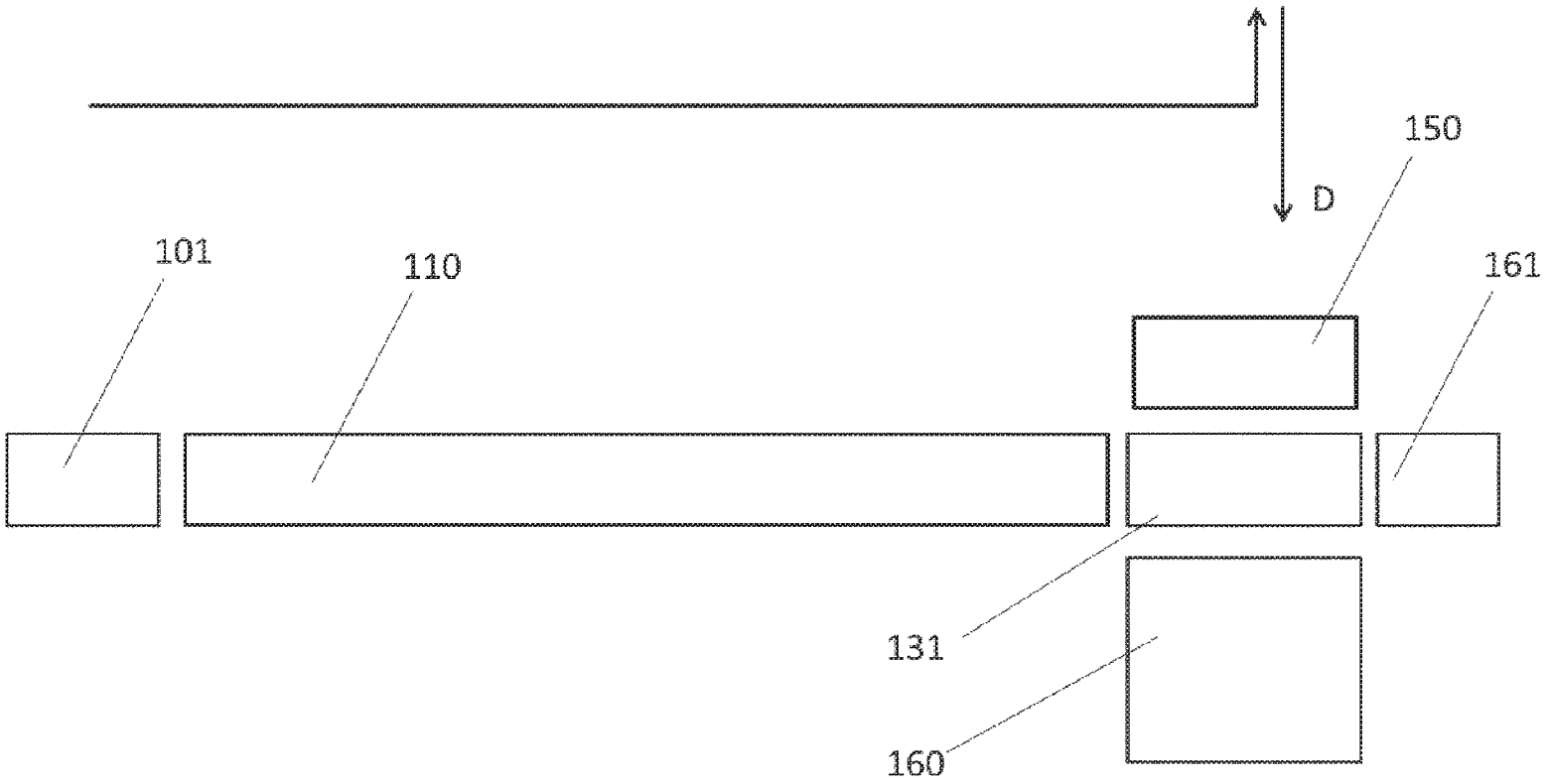
Figure 3:
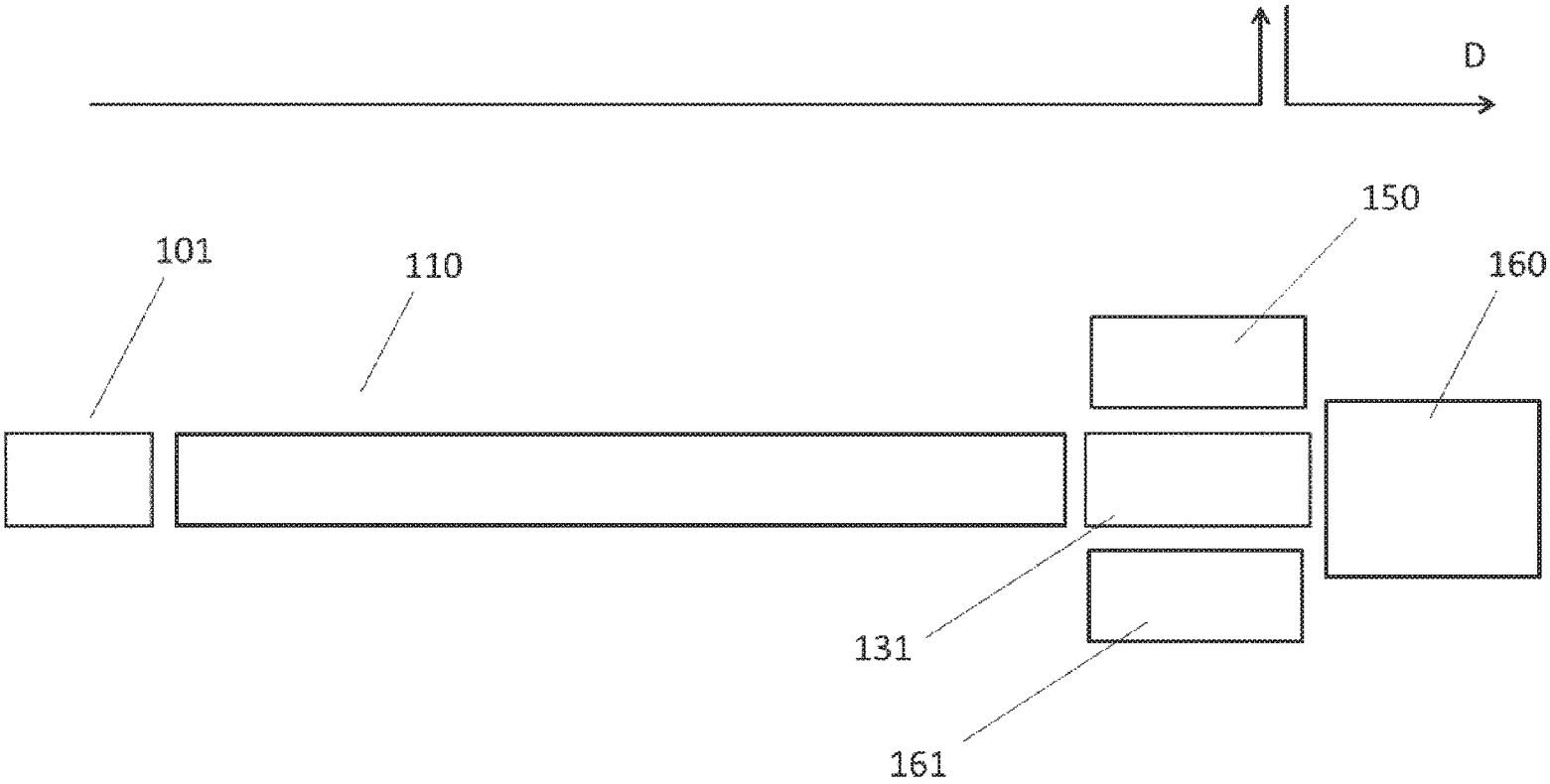
Figure 4:
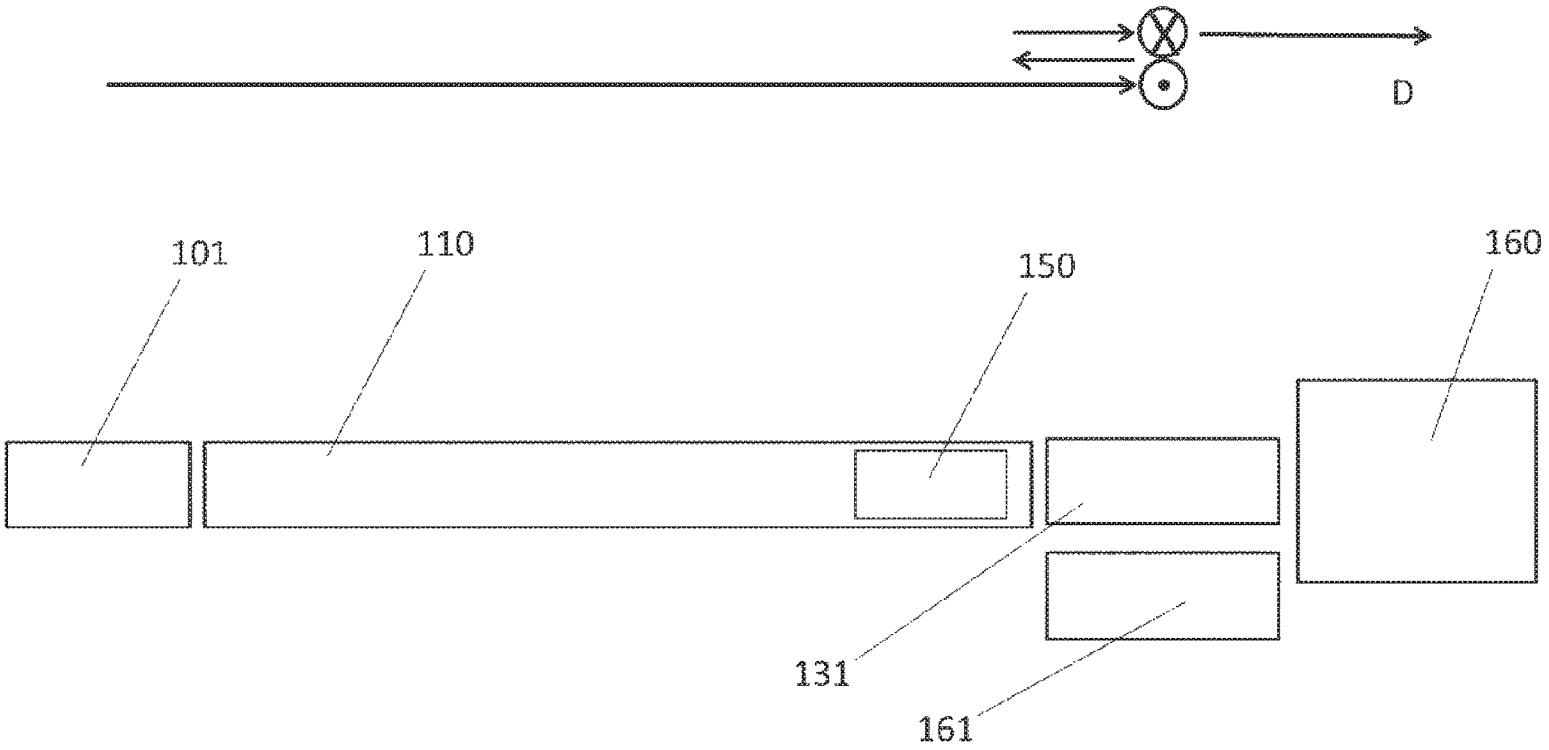

In the drawings:

FIG. 1 shows a typical temperature curve for the heat treatment of a steel component, with a first and a second region, FIG. 2 shows a thermal heat treatment apparatus according to the invention in a plan view, as a schematic drawing, FIG. 3 shows a further thermal heat treatment apparatus according to the invention, in a plan view, as a schematic drawing, FIG. 4 shows a further thermal heat treatment apparatus according to the invention, in a plan view, as a schematic drawing.

FIG. 1 is a typical temperature curve for the heat treatment of a steel component 200, with a first region 210 and a second region 220 according to the inventive method. The steel component 200 is heated in the furnace 110 to a temperature above the AC3 temperature during the dwell time $t_{110}$ in the furnace, according to the schematically-drawn temperature profile $\vartheta_{200,110}$.

Subsequently, the steel component 200 is transferred into the treatment station 150, with a transfer time $t_{120}$. The steel component loses heat during this time. In the treatment station, a second region 220 of the steel component 200 is rapidly cooled, wherein the second region 220 quickly loses heat in accordance with the indicated curve $\vartheta_{220,150}$. The cooling ends after the expiry of the treatment time $t_B$, which is only a few seconds, depending on the thickness of the steel component 200, the desired material properties, and the size of the second region 220. The second region 220 has now reached the cooling finish temperature $\vartheta_2$ above the martensite start temperature $M_S$. In this case, the temperature of the first region 210 of the steel component 200 may fall below the AC3 temperature, but this does not necessarily have to occur. On the other hand, the temperature of the second region 220 of the steel component 200 may rise again slightly during the dwell time $t_{150}$ due to recalescence, according to the temperature curve $\vartheta_{220,130}$ shown in the figure, without reaching the AC3 temperature, before continuing to slowly drop.

After the dwell time $t_{150}$ of the steel component 200 in the treatment station is finished, it is transferred during the transfer time $t_{131}$ into a press-hardening tool 160, where it is transformed and hardened during the dwell time $t_{160}$.

FIG. 2 shows a heat treatment apparatus 100 according to the invention, in a 90° arrangement. The heat treatment apparatus 100 has a loading station 101 via which the steel components are fed to the furnace 110. Furthermore, the heat treatment apparatus 100 comprises the treatment station 150. A removal station 131, which is equipped with a positioning device (not shown), is arranged further in the primary flow direction D behind the furnace 110. The primary flow direction at this point bends substantially 90° to allow a press-hardening tool 160 to follow in a press (not shown) in which the steel component 200 is press-hardened. A container 161 into which rejects can be placed is arranged in the axial direction of the furnace 110.

FIG. 3 shows a heat treatment apparatus 100 according to the invention, in a straight arrangement. The heat treatment apparatus 100 has a loading station 101 via which the steel components are fed to the furnace 110. Furthermore, the heat treatment apparatus 100 comprises the treatment station 150. A removal station 131, which is equipped with a positioning device (not shown), is arranged further in the primary flow direction D behind the furnace 110. A press-hardening tool 160 in a press (not shown) in which the steel component 200 is press-hardened follows in the continued, straight primary flow direction. A container 161 into which rejects can be placed is arranged essentially at 90° to the removal station 131.

FIG. 4 shows a further variant of a heat treatment apparatus 100 according to the invention. The heat treatment apparatus 100 again has a loading station 101 via which the steel components are fed to the furnace 110. The furnace 110 is preferably designed in this embodiment as a continuous furnace. Furthermore, the heat treatment apparatus 100 comprises the treatment station 150. The removal device 131 may have, for example, a gripping device (not shown). The removal station 131 removes, for example by means of the gripping device, the steel components 200 from the furnace 110. In contrast to the embodiment shown in FIG. 2, the treatment station 150 is arranged in this case on the furnace 110. This arrangement saves installation floor space. The primary flow direction changes, in this embodiment, the plane in which the steel component 200 is lifted from the removal station after leaving the furnace 110 and placed in the treatment station 150. After expiry of the dwell time $t_{150}$ of the steel component 200 in the treatment station 150, the removal station 131 removes the steel component 200 from the treatment station 150 and places it into a press-hardening tool 160 installed in a press. In the embodiment shown, the press is arranged in line with the furnace 110, while a container 161 for rejects is arranged at an angle to the furnace axis. The positions of the press with the tool 160 and container 161 can also be reversed.

The embodiments shown herein are only examples of the present invention and therefore should not be considered as limiting the same. Alternative embodiments contemplated by a person skilled in the art are equally within the scope of protection of the present invention.

LIST OF REFERENCE NUMBERS

100 heat treatment apparatus
110 furnace
131 removal station
150 treatment station
160 press-hardening tool
161 container
200 steel component
210 first region
220 second region
D primary flow direction
$M_S$ martensite start temperature
$t_B$ treatment time
$t_{110}$ dwell time in the furnace
$t_{120}$ transfer time of the steel component into the treatment station
$t_{131}$ transfer time of the steel component into the press-hardening tool
$t_{150}$ dwell time in the treatment station
$t_{160}$ dwell time in the press-hardening tool
$\vartheta_1$ microstructure transformation starting temperature
$\vartheta_2$ cooldown finish temperature
$\vartheta_3$ internal temperature, furnace
$\vartheta_{200,110}$ temperature profile of the steel component in the furnace
$\vartheta_{210,150}$ temperature profile of the first region of the steel component in the treatment station
$\vartheta_{220,150}$ temperature profile of the second region of the steel component in the treatment station
$\vartheta_{200,160}$ temperature profile of the steel component in the press-hardening tool

The invention claimed is:

1. A method for the targeted heat treatment of specific component zones of a steel component, wherein a predominantly austenitic structure is created in the steel component in one or more first regions, from which, by quenching, a majority martensitic microstructure is subsequently created, and in one or more second regions, a majority bainitic microstructure is subsequently created, the method comprising:

initially heating the steel component in a furnace to a temperature above the AC3 temperature, subsequently transferring the steel component into a treatment station, and cooling down in the treatment station the one or more second regions of the steel component to a cooling finish temperature $\vartheta_2$ during a treatment time $t_B$, wherein the temperature of the one or more second regions rises during a subsequent dwell time $t_{150}$ due to recalescence, without reaching the AC3 temperature.

2. The method according to claim 1, wherein the cooling finish temperature $\vartheta_2$ is selected to be higher than the martensite start temperature $M_S$.

3. The method according to claim 1, wherein the one or more second regions are cooled by one-sided blowing with a fluid.

4. The method according to claim 1, wherein during the treatment time $t_B$, no active heating of the second region or regions occurs in the treatment station.

5. The method according to claim 1, wherein during the treatment time $t_B$, the second region or regions are actively heated in the treatment station.

* * * * *